US008833317B2

(12) United States Patent
Yamaguchi et al.

(10) Patent No.: US 8,833,317 B2
(45) Date of Patent: Sep. 16, 2014

(54) VARIABLE VALVE MECHANISM

(75) Inventors: Koki Yamaguchi, Nishio (JP); Junichi Ookawara, Fuchu (JP); Dan Nagano, Musashino (JP)

(73) Assignees: Otics Corporation, Nishio-Shi, Aichi-Ken (JP); Fuji Jukogyo Kabushiki Kaisha, Tokyo (JP)

( * ) Notice: Subject to any disclaimer, the term of this patent is extended or adjusted under 35 U.S.C. 154(b) by 674 days.

(21) Appl. No.: 12/998,495

(22) PCT Filed: Nov. 25, 2009

(86) PCT No.: PCT/JP2009/069819

§ 371 (c)(1),
(2), (4) Date: Apr. 27, 2011

(87) PCT Pub. No.: WO2010/061829

PCT Pub. Date: Jun. 3, 2010

(65) Prior Publication Data

US 2011/0197838 A1 Aug. 18, 2011

(30) Foreign Application Priority Data

Nov. 26, 2008 (JP) ..... 2008-301742

(51) Int. Cl.

| | |
|---|---|
| ***F01L 1/34*** | (2006.01) |
| ***F01L 13/00*** | (2006.01) |
| *F01L 1/24* | (2006.01) |
| *F01L 1/18* | (2006.01) |

(52) U.S. Cl.

CPC ..... *F01L 13/0026* (2013.01); *F01L 1/2405* (2013.01); *F01L 1/185* (2013.01); *F01L 2013/0073* (2013.01); *F01L 2013/0068* (2013.01); *F01L 2105/00* (2013.01)

USPC ..... 123/90.16

(58) Field of Classification Search

CPC ... F01L 13/0026; F01L 1/185; F01L 13/0063; F01L 2013/0073

See application file for complete search history.

(56) References Cited

U.S. PATENT DOCUMENTS 7,032,551 B2 * 4/2006 Eguchi et al. ..... 123/90.16
7,600,496 B2 * 10/2009 Nakamura et al. ..... 123/90.16

(Continued)

FOREIGN PATENT DOCUMENTS

EP 1 726 792 A2 11/2006
JP 11-324625 A 11/1999

(Continued)

OTHER PUBLICATIONS

Notification of Reason(s) for Refusal dated Nov. 20, 2012, with English translation.

*Primary Examiner* — Thomas Denion
*Assistant Examiner* — Daniel Bernstein
(74) *Attorney, Agent, or Firm* — McGinn IP Law Group, PLLC

(57) ABSTRACT

A variable valve mechanism that is downsized by providing a crank mechanism in place of an egg-shaped cam on an input shaft that is rotationally driven by a crankshaft of an internal combustion engine. A variable valve mechanism (30) having a variable mechanism (30) that changes the opening/closing amount of a valve (13), includes an input shaft (12) that is rotationally driven by an internal combustion engine. The input shaft (12) is provided with a crank mechanism (14) that is connected to the variable mechanism (30) and converts the rotational motion of the input shaft (12) into reciprocating motion for opening and closing the valve (13).

3 Claims, 7 Drawing Sheets

(56) References Cited

U.S. PATENT DOCUMENTS

| | | | | |
|---|---|---|---|---|
| 8,079,332 | B2 * | 12/2011 | Kim et al. | 123/90.16 |
| 8,251,027 | B2 * | 8/2012 | Lee et al. | 123/90.16 |
| 2002/0033152 | A1 | 3/2002 | Hara et al. | |
| 2006/0266317 | A1 | 11/2006 | Fujita et al. | |
| 2006/0288972 | A1 * | 12/2006 | Hara et al. | 123/90.16 |
| 2011/0139102 | A1 * | 6/2011 | Kajiura et al. | 123/90.16 |

FOREIGN PATENT DOCUMENTS

| | | | |
|---|---|---|---|
| JP | 2006-329084 | A | 12/2006 |
| JP | 3996751 | B2 | 8/2007 |
| JP | 3996751 | B2 | 10/2010 |

* cited by examiner

VARIABLE VALVE MECHANISM

TECHNICAL FIELD

The present invention relates to a variable valve mechanism that controls valve characteristics depending on the operating state of an internal combustion engine.

BACKGROUND ART

As a variable valve mechanism that controls the lift amount, the working angle, and the open/close timing of a valve depending on the operating state of an internal combustion engine, there is conventionally known a variable valve mechanism 100 described in Patent Document 1, as shown in FIG. 7.

This variable valve mechanism 100 is provided with a camshaft 101 that is rotated by a crankshaft (not shown) of the internal combustion engine, and a valve member 103 that opens and closes a valve 102. The camshaft 101 is fixed thereon with a drive cam 104 in an integrally rotatable manner, and supports, in a relatively rotatable manner, an oscillating cam 106 that is provided with a cam surface 105 engaging with the valve member 103.

A control shaft 107 arranged in parallel with the camshaft 101 supports thereon a variable link 109 via an eccentric cam 108, in an oscillatable manner. One end of the variable link 109 is connected to the drive cam 104 with a ring-shaped link 110, whereas the other end of the variable link 109 is connected to the oscillating cam 106 with a rod-shaped link 111. Thus, the power of the drive cam 104 is transmitted to the oscillating cam 106 via the three links 109, 110, and 111, and the oscillating angle of the variable link 109 is changed by the eccentric cam 108. Thereby, the lift amount and the working angle of the valve 102 are changed depending on the operating state of the internal combustion engine.

Patent Document 1: Japanese Patent Application Publication No. JP-A-11-324625

DISCLOSURE OF THE INVENTION

Problem to be Solved by the Invention

In the variable valve mechanism 100, the control shaft 107 is provided above the camshaft 101 (on the side away from a cylinder). This increases the height of the entire variable valve mechanism 100, thereby increasing the overall height of a cylinder head.

Therefore, the inventors of the present invention have developed a variable valve mechanism in which a shaft supporting a variable mechanism is integrated with a control shaft. However, because a drive cam has been a so-called egg-shaped cam that has a base circle portion and a cam nose portion, it has been impossible to reduce the distance (axis-to-axis pitch) between the control shaft and the drive shaft to less than the height of the cam nose.

Therefore, it is an object of the present invention to provide a variable valve mechanism that is downsized by providing a crank mechanism in place of an egg-shaped cam on an input shaft that is rotationally driven by an internal combustion engine.

Means for Solving the Problem

In order to solve the problem described above, a variable valve mechanism of the present invention having a variable mechanism that changes the opening/closing amount of a valve is characterized in that the variable valve mechanism has an input shaft that is rotationally driven by an internal combustion engine, the input shaft is provided with a crank mechanism that converts the rotational motion of the input shaft into reciprocating motion for opening and closing the valve, and the crank mechanism is connected to the variable mechanism.

Here, the changing of the opening/closing amount of a valve is not limited to a particular case, and can include, for example, a case of switching between the state of driving the valve and the state of fully stopping driving the valve, and a case of switching between the state of opening/closing the valve with a relatively large lift amount and the state of opening/closing the valve with a relatively small lift amount.

The aspect of the variable mechanism is not particularly limited. However, because the variable mechanism has a reduced number of components and can reduce the overall size of the variable valve mechanism (can reduce particularly the height of the variable valve mechanism), it is a preferable aspect that the variable mechanism includes an input oscillating member connected to the crank mechanism, an output oscillating member that presses the valve, and a control member that rotates to displace the relative phase between the input oscillating member and the output oscillating member, and the input oscillating member and the output oscillating member are pivotally supported in an oscillatable manner by a control shaft provided in parallel with the input shaft, and the control member is provided on the control shaft.

It is a further preferable aspect that the variable mechanism includes a displacement member that is connected to the input oscillating member and the output oscillating member via connection members, and displaced by rotation of the control member, and that the distance changes between a center of a support portion protruding from the displacement member to support the two connection members in an oscillatable manner and an axial center of the control shaft, so that the relative phase between the input oscillating member and the output oscillating member is displaced.

The aspect of the displacement member is not particularly limited. However, the displacement member can be, for example, a ring arm composed of a ring portion rotatably fitting the outer side of the control member and an arm portion extending from the ring portion, or a roller that is pivotally supported in a rotatable manner and externally in contact with the control member. If a ring arm is used as the displacement member, the displacement member can follow the rotation of the control member, without a lost motion mechanism provided. On the other hand, if a roller is used as the displacement member, a lower friction to the control member is achieved.

The aspect of the control member is not particularly limited. However, the control member preferably has an outer circumferential surface whose distance from an axial center of the control shaft gradually changes. As a specific aspect, the control member can be, for example, a cylindrical control cam that is shifted from the axial center of the control shaft.

It is preferable to interpose a valve member between the output oscillating member and the valve so as to enable automatic adjustment of the valve clearance.

The aspect of the valve member is not particularly limited. However, the valve member can be, for example, a rocker arm that oscillates about a base end serving as a supporting point, or a valve lifter that can move in a straight line in the axial direction of the valve.

Effects of the Invention

According to the present invention, it is possible to provide a variable valve mechanism that is downsized by providing a crank mechanism in place of an egg-shaped cam on an input shaft that is rotationally driven by an internal combustion engine.

BEST MODES FOR CARRYING OUT THE INVENTION

A variable valve mechanism 10 having a variable mechanism 30 that changes the opening/closing amount of a valve 13 is characterized in that the variable valve mechanism 10 has an input shaft 12 that is rotationally driven by an internal combustion engine, the input shaft 12 is provided with a crank mechanism 14 that converts the rotational motion of the input shaft 12 into reciprocating motion for opening and closing the valve 13, and the crank mechanism 14 is connected to the variable mechanism 30.

The variable mechanism 30 has an input oscillating member connected to the crank mechanism 14, an output oscillating member 40 that presses the valve 13, and a control member 31 that rotates to displace the relative phase between the input oscillating member 35 and the output oscillating member 40. The input oscillating member 35 and the output oscillating member are pivotally supported in an oscillatable manner by a control shaft 25 provided in parallel with the input shaft 12. The control member 31 is provided on the control shaft 25, and has an outer circumferential surface 32 whose distance from an axial center 26 of the control shaft 25 gradually changes. The variable mechanism 30 has a displacement member 49 that is connected to the input oscillating member 35 and the output oscillating member 40 via connection members 46 and 47, and displaced by rotation of the control member 31.

The distance changes between a center 48 of a support portion 50 protruding from the displacement member 49 to support the two connection members 46 and 47 in an oscillatable manner and the axial center 26, so that the relative phase between the input oscillating member 35 and the output oscillating member 40 is displaced.

The displacement member 49 is a ring arm 49 composed of a ring portion 49*a* rotatably fitting the outer side of the control member 31 and an arm portion 49*b* extending from the ring portion 49*a*. The control member 31 is a cylindrical control cam 31 that is shifted from the axial center 26.

Embodiment

Next, an embodiment of the present invention will be described based on FIGS. 1 to 6. A variable valve mechanism 10 of the present embodiment is used in an intake system of an automotive gasoline engine. However, the same mechanism can also be applied to an exhaust system of the gasoline engine. As shown in FIGS. 1 to 3, an input shaft 12 of the variable valve mechanism 10 is supported by a housing (not shown) located above a cylinder head 11 (on the side away from a cylinder, the same applying hereinafter), and is rotationally driven by a crankshaft of the engine.

A crank mechanism 14 is provided at a position, in an intermediate portion of the input shaft 12, which corresponds to a valve 13. The crank mechanism 14 is composed of: a substantially cylindrical crank pin 15 that is fixed to the input shaft 12 so as to be shifted from an axial center 18 of the input shaft 12; and a crank rod 16 that has, at a base end thereof, a ring 17 rotatably fitting the outer side of the crank pin 15.

Below the input shaft 12 (on the side closer to the cylinder, the same applying hereinafter), a rocker arm 21 that automatically adjusts a valve clearance is supported in a manner vertically oscillatable by a pivot 22 located on the base end side, and urged upwardly by a spring (not shown) on the valve 13. A pressing surface 23 that presses the valve 13 is provided at a tip end of the rocker arm 21. A base roller 24 is rotatably supported at an intermediate portion of the rocker arm 21.

Above the rocker arm 21, a control shaft 25 is provided in parallel with the input shaft 12 with an axial center 26 located at the substantially same height as the axial center 18 of the input shaft 12. One end of the control shaft 25 is connected with an actuator (not shown) that is controlled according to the operating state of the engine to rotate the control shaft 25.

The control shaft 25 is provided with a variable mechanism 30. The variable mechanism 30 has a control cam 31 formed on the control shaft 25, a cam arm 40 that is pivotally supported in an oscillatable manner by the control shaft 25 next to the control cam 31 in the axial direction of the control shaft 25, a main arm 35 that is pivotally supported in an oscillatable manner by the control shaft 25 next to the cam arm 40 (on the opposite side of the control cam 31) in the axial direction of the control shaft 25, and a ring arm 49 that is connected to the main arm 35 via a first connection member 46 and to the cam arm 40 via a second connection member 47.

The control cam 31 is a so-called eccentric cam of a substantially cylindrical shape that is shifted from the axial center 26 of the control shaft 25. The control cam 31 has an outer circumferential surface (cam surface) 32 whose distance from the axial center 26 of the control shaft 25 gradually changes. The control cam 31 is fixed to the control shaft 25, thereby rotating with rotation of the control shaft 25.

The control shaft 25 is inserted through an intermediate portion of the cam arm 40. To an upper end of the cam arm 40, the second connection member 47 is pivotally attached by a member 51 in an oscillatable manner. The lower surface of the cam arm 40 serves as a cam surface 41 that comes into contact with the base roller 24 so as to press the valve 13 via the rocker arm 21.

The cam surface 41 is composed of a base surface portion 44 formed in an arc-shaped curved surface having a center at the axial center 26 of the control shaft 25, and a lift surface portion 45 of a concave curved surface shape continued from the base surface portion 44.

The control shaft 25 is inserted through an intermediate portion of the main arm 35. To one end of the main arm 35, the first connection member 46 is pivotally attached by a member 52 in an oscillatable manner. To the other end of the main arm 35, a tip end of the crank rod 16 is pivotally attached by a member 53 in an oscillatable manner.

The ring arm 49 is composed of a ring portion 49*a* rotatably fitting the outer side of the control cam 31, and an arm portion 49*b* extending from the ring portion 49*a*. A tip end of the arm portion 49*b* pivotally supports the first connection member 46 and the second connection member 47 with a connection pin 50 in an individually oscillatable manner.

In the variable mechanism 30 thus structured, the individual members are connected in an oscillatable manner.

The operation of the variable valve mechanism 10 will be described according to FIGS. 4 to 6.

FIG. 4 shows a displacement in relative phase between the main arm 35 and the cam arm 40 by rotation of the control cam 31. Specifically, both of FIGS. 4A and 4B show a case in which the tip end of the crank rod 16 is located farthest from the axial center 18 of the input shaft 12. FIG. 4A shows a state in which an axial center 48 of the connection pin 50 is located nearest to the axial center 26 of the control shaft 25, that is, a state in which the distance between the axial center 48 of the connection pin 50 and the axial center 26 of the control shaft 25 is the shortest. FIG. 4B shows a state in which the axial center 48 of the connection pin 50 is located farthest from the axial center 26 of the control shaft 25, that is, a state in which the distance between the axial center 48 of the connection pin 50 and the axial center 26 of the control shaft 25 is the longest. Note that the ring arm 49, the first connection member 46, and the second connection member 47 are shown by dashed lines, while the crank rod 16 is shown by an alternate long and two short dashed line.

As shown in FIGS. 4A and 4B, the control cam 31 rotates along with the rotation of the control shaft 25 so as to displace the ring arm 49 continuously. By displacing the ring arm 49 continuously, the distance between the axial center 48 of the connection pin 50 and the axial center 26 of the control shaft 25 is changed continuously.

By changing the distance between the axial center 48 of the connection pin 50 and the axial center 26 of the control shaft 25, the cam arm 40 pivotally supporting in an oscillatable manner the second connection member 47 that is pivotally supported by the connection pin 50 is oscillated about the control shaft 25 serving as an oscillation center, thereby changing the location on the cam surface 41 where the cam arm 40 comes into contact with the base roller 24.

Specifically, if the axial center 48 of the connection pin 50 is located nearest to the axial center 26 of the control shaft 25, the cam arm 40 comes into contact with the base roller 24 at a location in the base surface portion 44 away from the lift surface portion 45, as shown in FIG. 4A. On the other hand, if the axial center 48 of the connection pin 50 is located farthest from the axial center 26 of the control shaft 25, the cam arm 40 comes into contact with the base roller 24 at a location in the base surface portion 44 near the lift surface portion 45, as shown in FIG. 4B.

Therefore, as the distance between the axial center 48 of the connection pin 50 and the axial center 26 of the control shaft 25 increases, that is, as the axial center 48 of the connection pin 50 is farther away from the axial center 26 of the control shaft 25, the cam arm 40 comes into contact with the base roller 24 at a location in the base surface portion 44 nearer to the lift surface portion 45. In contrast, as the distance between the axial center 48 of the connection pin 50 and the axial center 26 of the control shaft 25 decreases, that is, as the axial center 48 of the connection pin 50 comes closer to the axial center 26 of the control shaft 25, the cam arm 40 comes into contact with the base roller 24 at a location in the base surface portion 44 farther away from the lift surface portion 45.

On the other, hand, although pivotally supporting in an oscillatable manner at one end the first connection member 46 that is pivotally supported by the connection pin 50, the main arm 35 is connected at the other end to the tip end of the crank rod 16. Therefore, the main arm 35 does not oscillate unless the position of the tip end of the crank rod 16 changes. Accordingly, the relative phase between the main arm 35 and the cam arm 40 is displaced continuously by changing the distance between the axial center 48 of the connection pin 50 and the axial center 26 of the control shaft 25 continuously.

FIG. 5 shows the operation of the variable valve mechanism 10 when opening and closing the valve 13 by a minimum lift amount. Both of FIGS. 5A and 5B show a state of the control cam 31 in which the lift amount when the valve 13 is lifted to the maximum is the smallest, that is, a state in which the distance between the axial center 48 of the connection pin 50 and the axial center 26 of the control shaft 25 is the shortest when the valve 13 is depressed to the maximum (in the state of FIG. 5B).

As shown in FIG. 5A, if the tip end of the crank rod 16 is located farthest from the axial center 18 of the input shaft 12, the base roller 24 comes in contact with the cam arm 40 at a location in the base surface portion 44 away from the lift surface portion 45. At the same time, the valve 13 is in the closed position.

When the input shaft 12 rotates, the crank pin 15 follows the rotation to rotate about the axial center 18 of the input shaft 12 serving as a rotational center. The rotation of the crank pin 15 displaces the crank rod 16 that has at the base end thereof the ring 17 rotatably fitting the outer side of the crank pin 15, thereby changing the distance between the tip end of the crank rod 16 and the axial center 18 of the input shaft 12. Because the tip end of the crank rod 16 is pivotally attached to an end of the main arm 35, the displacement of the tip end (particularly, the center of the axis pivotally supported by the main arm) of the crank rod 16 results in a displacement of a certain length along a circular arc about the axial center 26 of the control shaft 25. Thus, the rotation of the input shaft 12 makes the tip end of the crank rod 16 perform reciprocating motion of a certain length along the circular arc. Thereby, the rotational motion of the input shaft 12 is converted into the reciprocating motion acting on the main arm 35 (eventually, opening and closing the valve 13).

Next, when the distance between the tip end of the crank rod 16 and the axial center 18 of the input shaft 12 changes (the tip end of the crank rod 16 performs the reciprocating motion), the main arm 35 oscillates. When the main arm 35 oscillates, the ring arm 49 connected to the main arm 35 via the first connection member 46 oscillates about the control cam 31 serving as an oscillation center. When the ring arm 49 oscillates, the cam arm 40 connected to the ring arm 49 via the second connection member 47 oscillates. When the cam arm 40 oscillates, the base roller 24 slides on the cam surface 41. While the base roller 24 is in contact with the base surface portion 44, the rocker arm 21 does not produce a force to depress the valve 13 against the urging force of the spring, thus holding the valve 13 in the closed position. Then, when the base roller 24 comes into contact with the lift surface portion 45, the cam arm 40 depresses the rocker arm 21. By this action, the pressing surface 23 depresses the valve 13 against the urging force of the spring.

As shown in FIG. 5B, when the tip end of the crank rod 16 comes nearest the axial center 18 of the input shaft 12, the base roller 24 slides on the lift surface portion 45 by a short distance. By this action, the cam arm 40 depresses the rocker arm 21 by a small amount. Then, the rocker arm 21 depresses the valve 13 by a small amount against the urging force of the spring, and thereby the valve 13 is opened by a minimum lift amount (Lmin).

FIG. 6 shows the operation of the variable valve mechanism 10 when opening and closing the valve 13 by a maximum lift amount. Both of FIGS. 6A and 6B show a state of the control cam 31 in which the lift amount when the valve 13 is lifted to the maximum is the largest, that is, a state in which the distance between the axial center 48 of the connection pin 50 and the axial center 26 of the control shaft 25 is the longest when the valve 13 is depressed to the maximum (in the state of FIG. 6B).

As shown in FIG. 6A, if the tip end of the crank rod 16 is located farthest from the axial center 18 of the input shaft 12, the base roller 24 comes into contact with the cam arm 40 at a location in the base surface portion 44 near the lift surface portion 45. At the same time, the valve 13 is in the closed position.

As shown in FIG. 6B, when the tip end of the crank rod 16 comes nearest the axial center 18 of the input shaft 12, the base roller 24 slides on the lift surface portion 45 by a long distance. Thereby, the cam arm 40 depresses the rocker arm 21 by a large amount. Then, the rocker arm 21 depresses the valve 13 by a large amount against the urging force of the spring, and thereby the valve 13 is opened by a maximum lift amount (Lmax).

According to the present embodiment, the following effects (a) to (e) are obtained.

(a) By using the crank mechanism 14 in place of an egg-shaped cam, the distance (axis-to-axis pitch) between the control shaft 25 and the input shaft 12 can be reduced, whereby the variable valve mechanism can be downsized. More specifically, the egg-shaped cam can only press the portion in contact with the variable mechanism. However, the crank mechanism can alternately perform operations of pressing and pulling the portion connected with the variable mechanism, and therefore that portion of the variable mechanism can be displaced by a longer distance.

(b) By using the crank mechanism 14 in place of an egg-shaped cam, it is possible to eliminate a lost motion mechanism for making the variable mechanism come into contact with the egg-shaped cam.

(c) Because the variable mechanism 30 is supported by the control shaft 25, the overall height of the cylinder head can be made smaller than that of other continuously variable valve mechanisms (such as the variable valve mechanism 100) of a rotation control system. Accordingly, it is possible to downsize the variable valve mechanism.

(d) By connecting the members of the variable mechanism 30 to form a so-called linkage mechanism, it is possible to eliminate a lost motion mechanism for following the control cam.

(e) By providing the variable valve mechanism for each valve 13 (to be completed for a single valve), the variable valve mechanism can be mounted in an internal combustion engine without an influence from surrounding parts, such as a plug tube provided in the upper central portion of a cylinder, and an injector.

Note that the present invention is not limited to the embodiment described above, and can be put into practice within a scope not departing from the gist of the invention.

For example, the present invention can include an aspect in which the ring arm is eliminated by providing the displacement member as a member that comes into contact with the control cam.

DESCRIPTION OF THE REFERENCE NUMERALS

Figure 1:
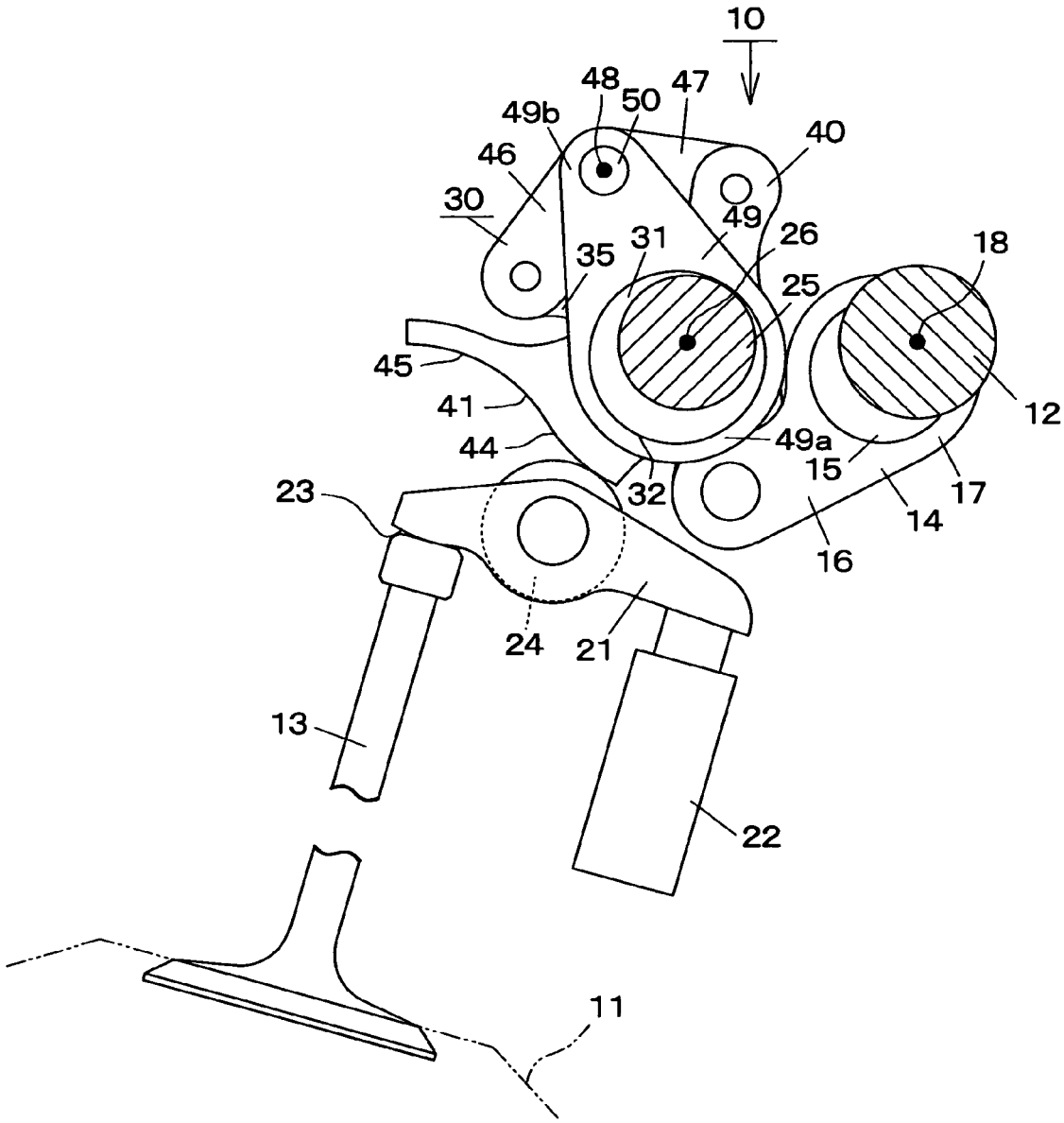
FIG. 1 is an overall view of a variable valve mechanism of the present invention.
Figure 2:
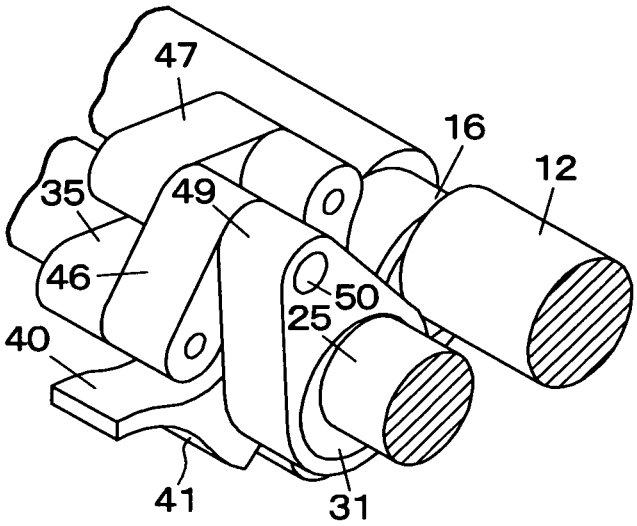
FIG. 2 is a perspective view of a variable mechanism of the variable valve mechanism.
Figure 3:
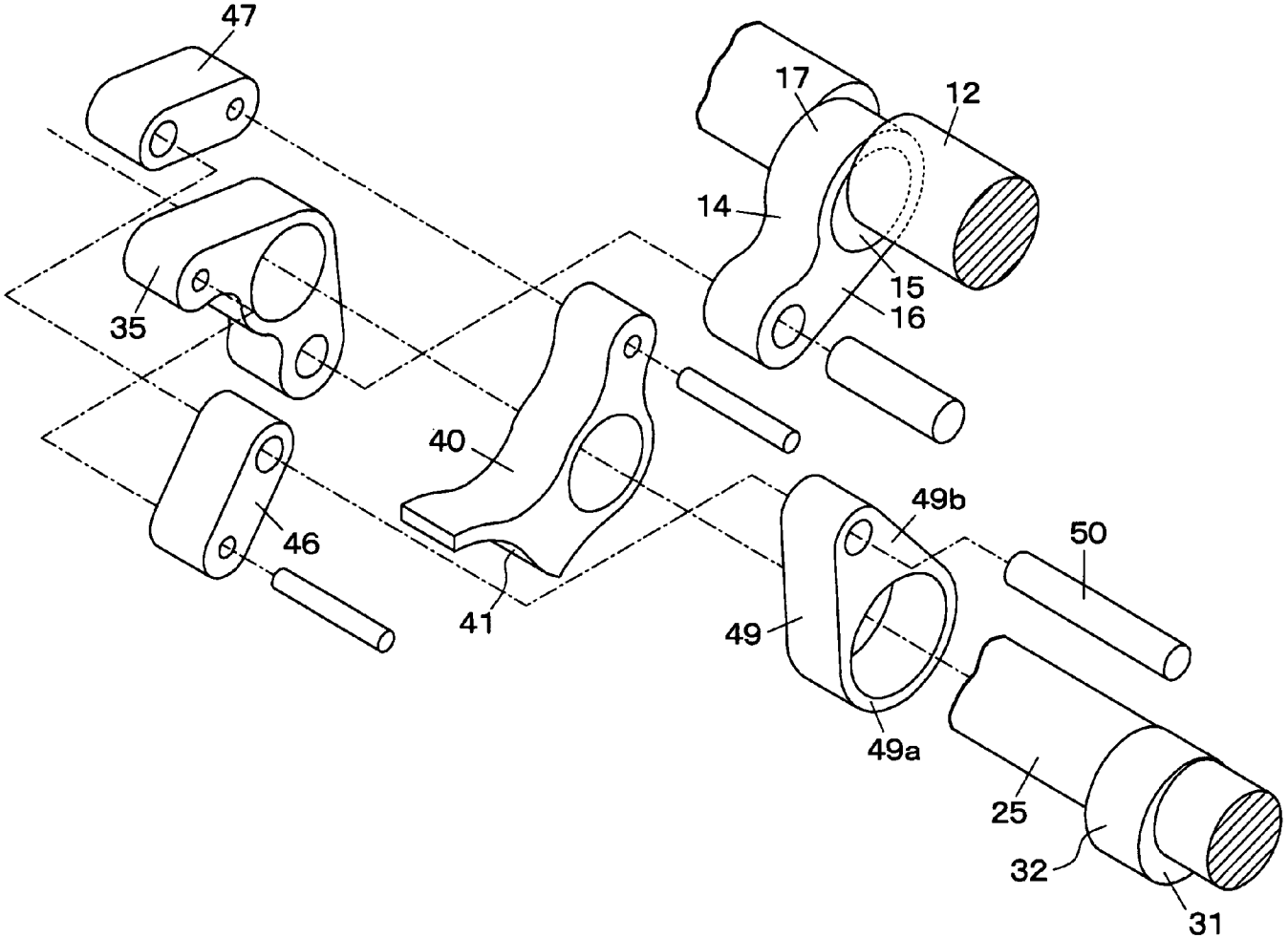
FIG. 3 is an exploded perspective view of the variable mechanism of the variable valve mechanism.
Figure 4A:
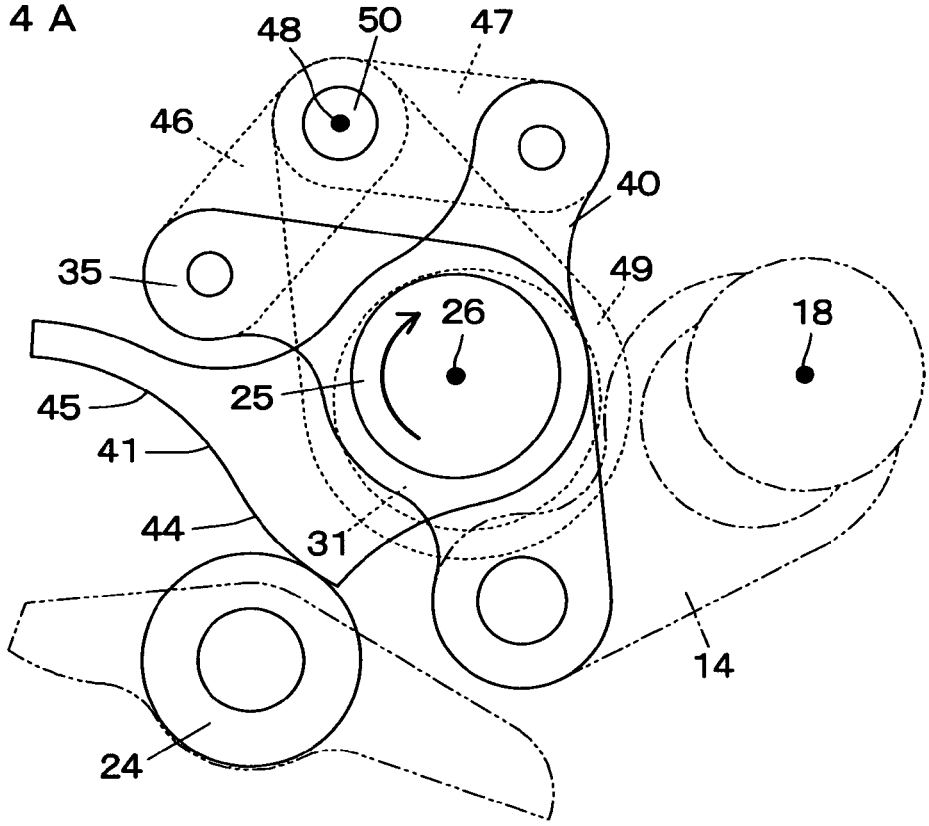
FIG. 4 shows explanatory diagrams illustrating a displacement of a cam arm caused by rotation of a control cam of the variable valve mechanism.
Figure 4B:
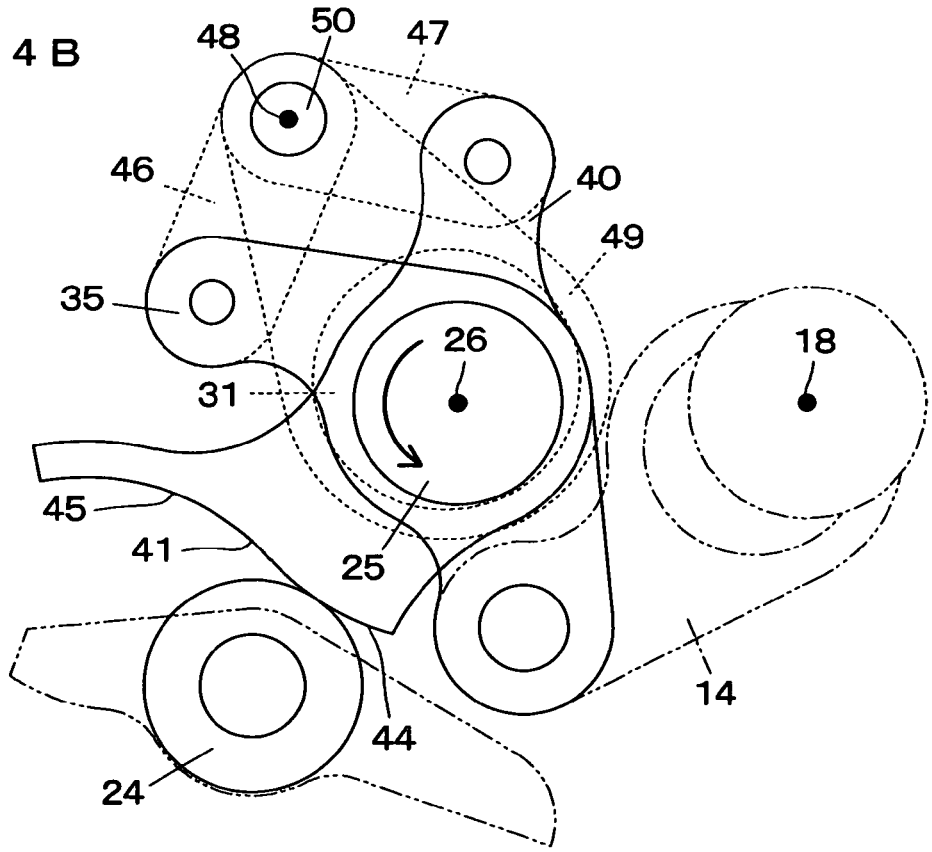
Figure 5B:
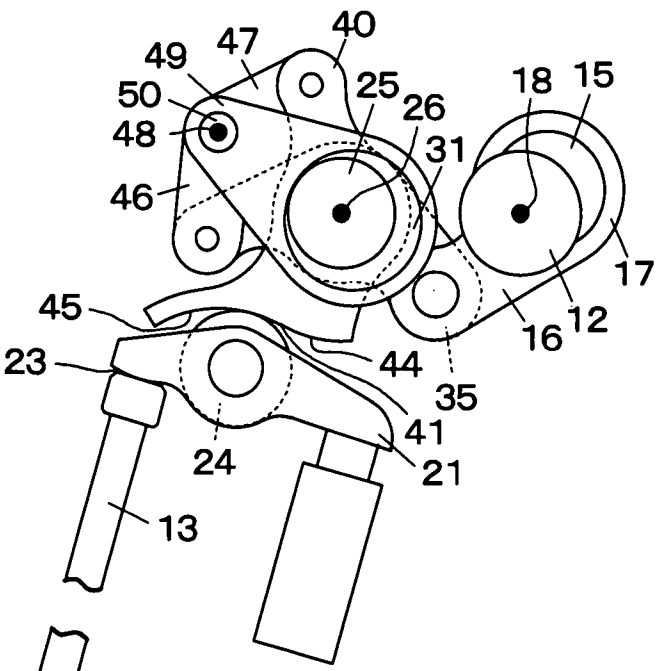
FIG. 5 shows explanatory diagrams illustrating a case in which a valve lift amount is minimized in the variable valve mechanism.
Figure 5A:
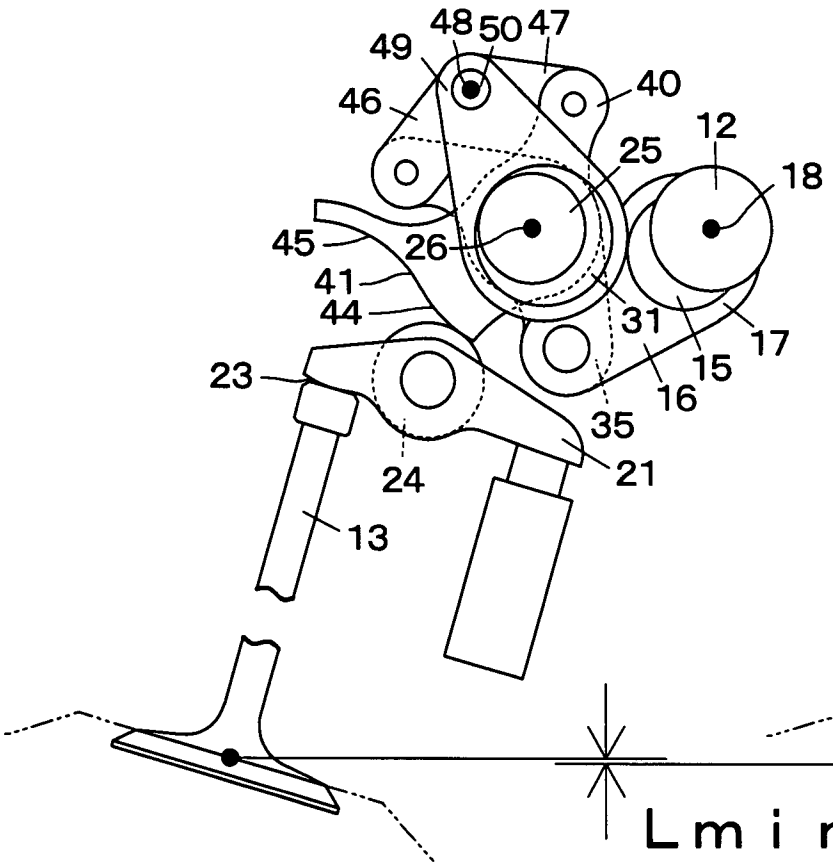
Figure 6B:
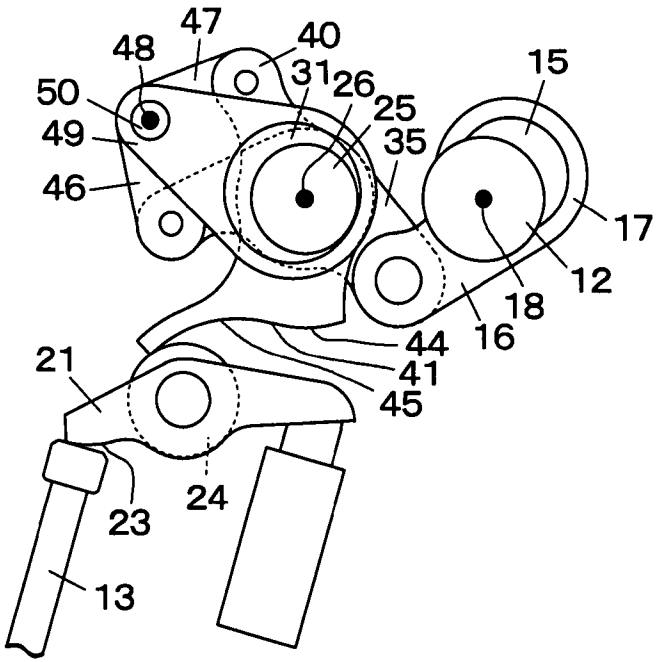
FIG. 6 shows explanatory diagrams illustrating a case in which the valve lift amount is maximized in the variable valve mechanism.
Figure 6A:
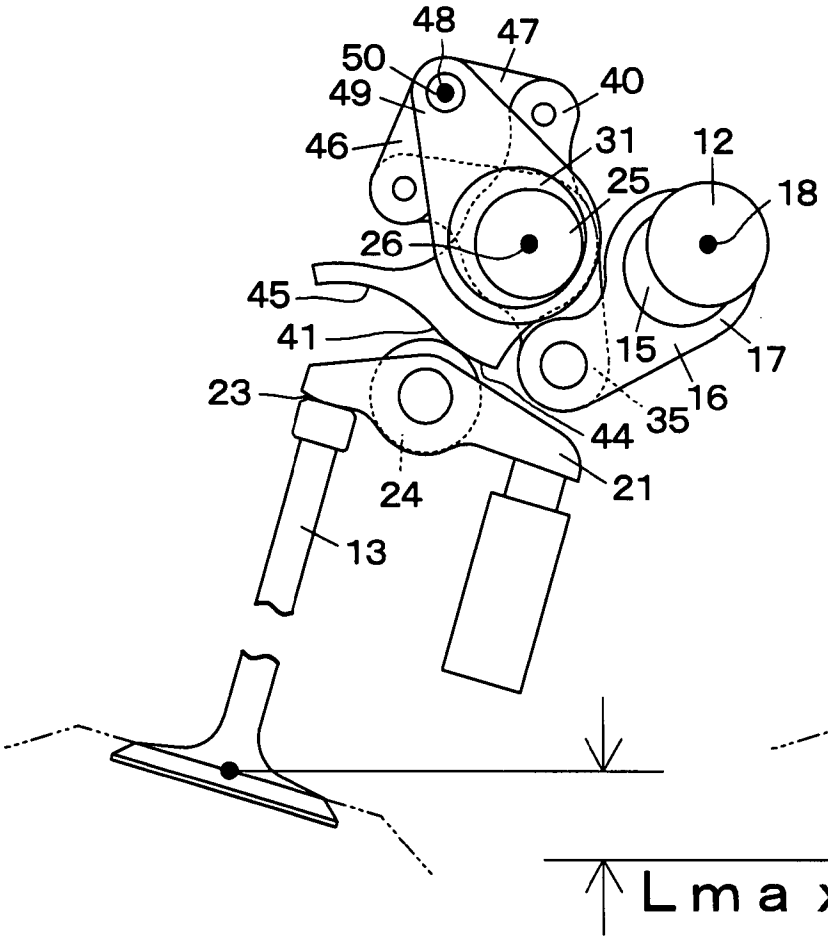
Figure 7:
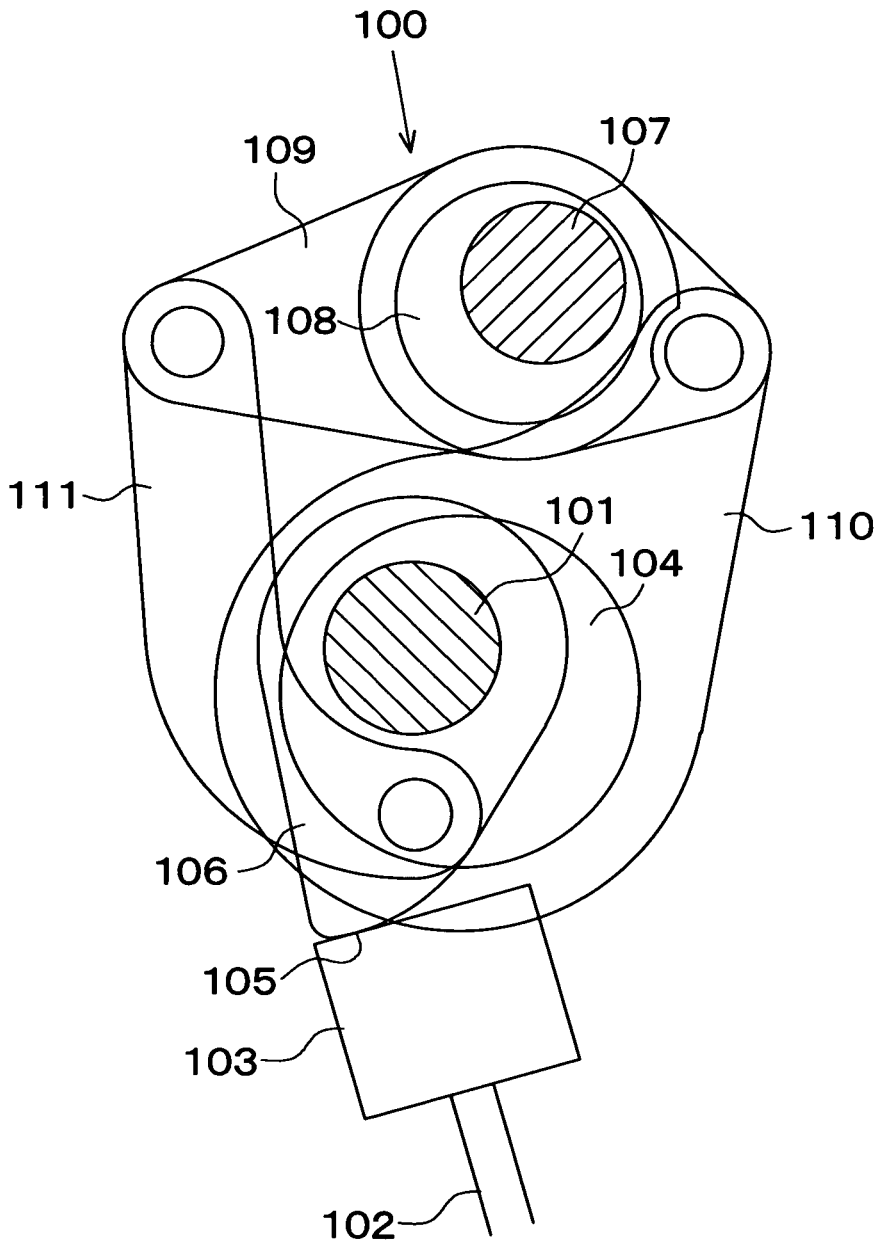
FIG. 7 is an overall view of a variable valve mechanism of the related art.

10 variable valve mechanism
12 input shaft
13 valve
14 crank mechanism
21 rocker arm
25 control shaft
26 axial center of control shaft
30 variable mechanism
31 control cam
32 outer circumferential surface
35 main arm
40 cam arm
41 cam surface
46 first connection member
47 second connection member
48 axial center of connection pin
49 ring arm
49*a* ring portion
49*b* arm portion
50 connection pin

The invention claimed is:

1. A variable valve mechanism having a variable mechanism that changes the opening/closing amount of a valve, comprising:

an input shaft that is rotationally driven by an internal combustion engine, the input shaft including a crank mechanism that converts the rotational motion of the input shaft into reciprocating motion for opening and closing the valve, the crank mechanism being connected to the variable mechanism;

wherein the variable mechanism includes an input oscillating member connected to the crank mechanism, an output oscillating member that presses the valve, and a control member that rotates to displace the relative phase between the input oscillating member and the output oscillating member, the input oscillating member and the output oscillating member are pivotally supported in an oscillatable manner by a control shaft provided in parallel with the input shaft, and the control member is provided on the control shaft; and wherein the control member has an outer circumferential surface whose distance from an axial center of the control shaft gradually changes, the variable mechanism includes a displacement member that is connected to the input oscillating member and the output oscillating member via connection members, and displaced by rotation of the control member and the distance changes between a center of a support portion protruding from the displacement member to support the two connection members in an oscillatable manner and the axial center, so that the relative phase between the input oscillating member and the output oscillating member is displaced.

2. The variable valve mechanism according to claim 1, wherein the displacement member comprises a ring arm including a ring portion rotatably fitting the outer side of the control member and an arm portion extending from the ring portion.

3. The variable valve mechanism according to claim 1 or 2, wherein the control member comprises a cylindrical control cam that is shifted from the axial center.

* * * * *